US007219474B2

(12) United States Patent
Lawson et al.

(10) Patent No.: US 7,219,474 B2
(45) Date of Patent: May 22, 2007

(54) LOAD BEARING BUILDING PANEL

(75) Inventors: Geoffrey Lawson, McLeans Ridges (AU); John Westera, Southport (AU); Russell Wells, deceased, late of Terranora (AU); by Ruth Wells, legal representative, Terranora (AU)

(73) Assignee: Onecrete Pty Ltd., New South Wales (AU)

( * ) Notice: Subject to any disclaimer, the term of this patent is extended or adjusted under 35 U.S.C. 154(b) by 341 days.

(21) Appl. No.: 10/468,922

(22) PCT Filed: Feb. 21, 2002

(86) PCT No.: PCT/AU02/00193

§ 371 (c)(1),
(2), (4) Date: Dec. 31, 2003

(87) PCT Pub. No.: WO02/066757

PCT Pub. Date: Aug. 29, 2002

(65) Prior Publication Data

US 2004/0098934 A1 May 27, 2004

(30) Foreign Application Priority Data

Feb. 21, 2001 (AU) ..... PR3316

(51) Int. Cl.
*E04B 1/00* (2006.01)

(52) U.S. Cl. ..... 52/250; 52/431; 52/432; 52/587.1

(58) Field of Classification Search ..... 52/732.3, 52/737.6, 272, 587.1, 405.1, 432, 254, 431, 52/434, 250, 251, 253, 259

See application file for complete search history.

(56) References Cited

U.S. PATENT DOCUMENTS

| | | | | |
|---|---|---|---|---|
| 1,350,686 | A | 8/1920 | Trudelle | |
| 1,684,195 | A * | 9/1928 | Olmsted | 52/649.1 |
| 2,075,560 | A * | 3/1937 | Warren | 52/434 |
| 2,193,994 | A | 3/1940 | Weaver | |
| 2,645,114 | A | 7/1953 | Amirikian | |
| 2,645,929 | A * | 7/1953 | Jones | 52/405.3 |
| 3,585,771 | A * | 6/1971 | Pinniger | 52/251 |
| 5,283,999 | A | 2/1994 | Cooney | |
| 5,417,023 | A * | 5/1995 | Mandish | 52/348 |
| 6,112,489 | A * | 9/2000 | Zweig | 52/405.1 |
| 6,202,375 | B1 * | 3/2001 | Kleinschmidt | 52/309.11 |
| 6,233,891 | B1 * | 5/2001 | De Cosse | 52/309.12 |

FOREIGN PATENT DOCUMENTS

| | | |
|---|---|---|
| AU | 13267/23 | 0/1923 |
| AU | 14777/23 | 0/1923 |
| AU | 3482/46 | 11/1946 |
| DE | 1509588 | 2/1969 |
| GB | 2026126 | 1/1980 |
| JP | 11256765 | 9/1999 |
| JP | 2000-303599 | 10/2000 |
| WO | WO 98/30768 | 7/1998 |

* cited by examiner

*Primary Examiner*—Jeanette Chapman
*Assistant Examiner*—Jessica Laux
(74) *Attorney, Agent, or Firm*—Abelman, Frayne & Schwab

(57) ABSTRACT

A load bearing building panel (10) is composed of light weight concrete and reinforcing within the panel body (11) adjacent to the first and second major faces (12, 13). The reinforcing (18, 19) extends in a horizontal direction for most of the width of the panel and in a vertical direction for most of the height. In addition, the reinforcing extends about apertures near the upper and lower faces (16, 17). The apertures a suitable for fasteners to extend there through. A load bearing column is disclosed with top and bottom portions engageable with a structure they are resting upon. A triangular cross-section tubular member extends between and is attached to the top and bottom portions.

8 Claims, 10 Drawing Sheets

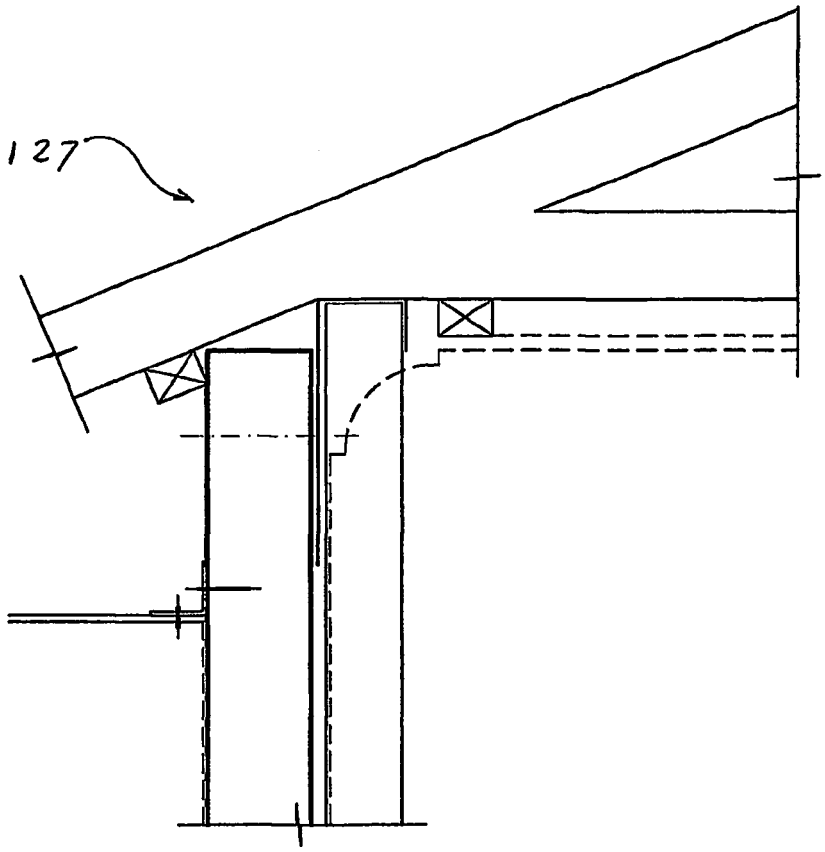
FIG. 8
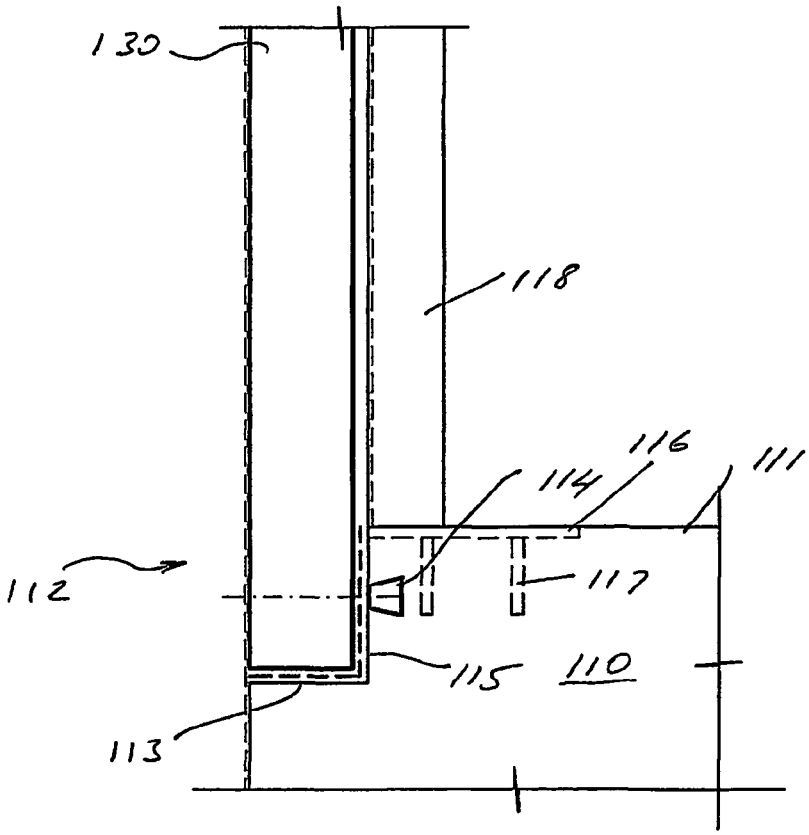

LOAD BEARING BUILDING PANEL

This application is a 371 of PCT/AU02/00193, filed 02/21/2002 and which claims priority from Australian application PR 3316, filed 02/21/2001.

This invention relates to a load bearing building panel.

This invention has particular but not exclusive application to a load bearing building panel made predominantly from light weight concrete which may be used in the construction of buildings, and wherein reference will be made to same.

Many buildings, including those used as dwellings, are built upon a foundation comprising a concrete slab. The external walls of the building typically are mounted on the peripheral edges of the concrete slab and may comprise a plurality of timber or metal frames.

The external face of the frames is often concealed behind a suitable form of cladding, such as lengths of timber or panels constructed from light weight composite materials, including light weight concrete, which are fastened to the frames.

The internal face of the frames may also be concealed behind a suitable form of cladding, such as sheets of plaster board, that are fastened to the frames.

The frames also provide support for a roof structure and wherein elongate fasteners, known as tie rods, that extend through the frames, are often used to secure the roof structure directly to the foundation.

It will be appreciated that the aforementioned method of constructing a building is very time consuming and requires the co-ordination of different suppliers and tradesmen. Delays in the supply of materials and/or the availability of tradesmen can add greatly to the cost of the construction of the building. It is also noted that the quality of workmanship provided by different tradesmen may vary considerably and thereby may have a detrimental effect on the value of the building.

Other building methods, commonly referred to as "tilt-up construction", comprise walls manufactured from concrete. These are usually lifted into place on site with the aid of a crane. Accordingly, while such methods of construction may be less time consuming than the more traditional method described above, the handling of heavy walls made of concrete is more hazardous.

One object of the present invention is to provide a load bearing building panel manufactured from a reinforced, light weight, concrete material which may be used in the construction of external walls of buildings and such like in place of the various methods of wall construction discussed above. It is envisaged that the load bearing building panel that is the subject of the present invention will be light enough that it may be located in position by either two tradesmen or with the aid of small lifting equipment, such as a bobcat, or other mechanical apparatus with a lifting arm attachment. Furthermore, the reinforcing in combination with the concrete shall resist imposed loading such as from roof, lintels and upper floors, and provide protection against lateral impact loads, such as may occur as a consequence of acts of vandalism, or due to flying debris during high wind and cyclonic conditions.

It is also desirous to develop an alternative method of constructing buildings wherein non load bearing wall panels manufactured from reinforced concrete may be used in place of the much heavier concrete wall panels that are currently used in tilt-up constructions.

With the foregoing in view, this invention in one aspect resides broadly in a load bearing building panel, including:

a body composed of a light weight concrete material, said body having an obverse face and an opposing reverse face, and two opposing side faces, said obverse face, reverse face and side faces being located intermediate opposing upper and lower faces;

a first reinforcing contained within said body and located adjacent said obverse face, said first reinforcing extending through said body in the general direction of said upper and lower faces for at least much of the length of said body, said first reinforcing also extending through said body in the general direction of the side walls for at least much of the width of said body;

a second reinforcing contained within said body and located adjacent said reverse face, said second reinforcing extending through said body in the general direction of said upper and lower faces for at least much of the length of said body, said second reinforcing also extending through said body in the general direction of said side walls for at least much of the width of said body, and wherein said first reinforcing and/or said second reinforcing includes both upper and lower engaging portions each of which are capable of at least partially extending about a fastener that extends through said body between said obverse and reverse faces.

The body may be any suitable shape. For example, the shape of the body may generally resemble a rectangularly shaped prism and wherein the obverse and reverse faces, the two side faces, and the upper and lower faces may lie in planes that are substantially parallel. However, it will also be appreciated that the obverse and reverse faces, and/or the two side faces, and/or the upper and lower faces may lie in planes that diverge.

The size of the body will generally be dependent upon individual job constraints, such as ceiling heights, single or two story construction, roof loadings, design wind loadings, manual or machine positioning units, and the like. Nevertheless it is preferred that the upper and lower faces are each short, (distance separating the opposing side faces which is preferably much smaller than the distance that separates the upper and lower faces) narrow (distance separating the obverse and reverse faces) faces that are generally rectangular in shape. It is also Preferred that the two side faces are two long, (distance separating the upper and lower faces which is preferably much greater than the distance separating opposing side faces), narrow, (distance separating the obverse and reverse faces), faces that are generally rectangular in shape. Similarly it is preferred that the obverse and reverse faces are two long, (distance separating opposing upper and lower faces which is preferably much greater than the distance separating opposing side faces), broad, (distance separating the opposing side faces which is preferably much greater than the distance separating the obverse and reverse faces), faces that are generally rectangular in shape. For example, the length of the body, (distance separating the upper and lower faces), may vary between 1800 mm and 3600 mm; the width of the body, (distance separating the two opposing side faces), may vary between 300 mm and 900 mm, and the depth of the body, (distance separating the obverse and reverse faces), may vary between 70 mm and 150 mm.

Each face may generally comprise a single surface. By way of example, the surface may be substantially flat or it may be curved.

Alternatively each face may include a plurality of surfaces. These surfaces may be either substantially flat or curved, or a combination of both flat and curved surfaces. For example, a face may have a corrugated surface.

The surfaces may have any suitable texture. For example, the surfaces may be generally rough or smooth, and may be rendered in a decorative manner, such as a surface finish that resembles rows of bricks.

The body may be manufactured from any suitable light weight concrete material including light weight concrete materials of the type that is referred to as "Autoclave Aerated Concrete".

The first and second reinforcing may each comprise a sheet of a reinforcing material, such as steel. The sheet may include one or more apertures formed therein and wherein these may be arranged in an ordered or a random manner. For example, the reinforcing may resemble a mesh like structure.

Alternatively the first and second reinforcing may each include a one or more elongate reinforcing members manufactured from a suitable material, such as steel. For example, each reinforcing may comprise a plurality of rod like reinforcing members that may be interconnected together, such as by a welding process or using a plurality of wire ties. For example, rod like reinforcing members in combination with one another may form a mesh like structure.

In one embodiment, each of the engaging portions may comprise an aperture or opening formed in the reinforcing. For example, the engaging portion may comprise an aperture formed in a sheet of a closed or open material, such as a mesh like material. Alternatively, each of the engaging portions may comprise a loop or hook like portion of a reinforcing member that is attached to or forms an integral part of the reinforcing. For example, the attachment of the loop or hook like reinforcing member to the reinforcing may be achieved using a welding process or a plurality of wire ties.

As with panel sizes, steel reinforcement sizes will be dictated by the individual job constraints and the loading imposed.

In another aspect, this invention relates to a method of constructing a building, said method including:

the provision of a foundation;

the erection of one or more external walls comprising at least some of which include a load bearing building panel of the type described above, and wherein said panel is secured to the foundation by a fastener that is at least partially surrounded by a lower engaging portion;

the affixing of a floor or a roof structure to said external wall or external walls, said floor or roof structure being spaced from the foundation by said external wall or external walls, said floor or roof structure being secured to said load bearing building panel by a fastener that is at least partially surrounded by an upper engaging portion.

In one embodiment, the foundation may include a concrete slab upon which the building shall be built. The edges of the slab may include a recessed portion that is adapted to receive a lower portion of at least some of the building panels. In such cases, a load bearing building panel may be secured to the concrete slab by a fastener that extends through said panel and which engages with said slab, said fastener being at least partially surrounded by a lower engaging portion of reinforcing contained within the panel.

Alternatively, the foundation may include a plurality of footings, such as a plurality of concrete pillars which may be buried beneath the ground. The footings may be used to provide support for posts, which themselves support beams that are suspended above the ground. In such cases, a load bearing building panel may be secured to a beam by a fastener that extends through said panel and which engages with said beam, said fastener being at least partially surrounded by a lower engaging portion of reinforcing contained within the panel.

In another aspect, this invention relates to a load bearing column, said column including:

a base portion that is engageable with a supporting structure upon which it rests;

a top portion that is engageable with a supported structure that rests upon said top portion, and a tubular member having a triangularly shaped transverse cross-section having a lower end portion that is attached to said base portion and an upper end portion that is attached to said top portion.

The supporting structure may include a foundation, such as a concrete slab, or a floor of a building. The base portion may be cast into the slab or floor during construction or alternatively attached thereto using one or more fasteners.

The supported structure may include a floor or roof structure of a building. The top portion may be cast into the floor or roof structure during construction or alternatively attached thereto using one or more fasteners.

The tubular member may be attached to the base member and the top member using a plurality of fasteners. Alternatively, the tubular member may be attached to the base member and the top member using a welding process.

Preferably the tubular member is constructed from mild steel.

In another aspect, this invention relates to a method of constructing a building including:

providing a foundation;

securing a plurality of triangularly shaped load bearing columns of the type described above to said foundation, said columns being adapted to provide support for a roof or floor structure;

constructing walls using a plurality of wall panels having lower edge portions that are secured to said foundation and wherein an elongate edge of at least one of the columns is located in a corner formed by adjacent wall panels, and securing upper portions of the wall panels to said roof or floor structure.

The wall panels may be constructed from a variety of materials including reinforced lightweight concrete which may be non load bearing or of the type previously described above.

In order that this invention may be more easily understood and put into practical effect, reference will now be made to the accompanying drawings which illustrate preferred embodiments of the invention and wherein:

FIG. 8 is a side view of a portion of a single story building constructed in accordance with the invention illustrated in FIG. 6;

Figure 1:
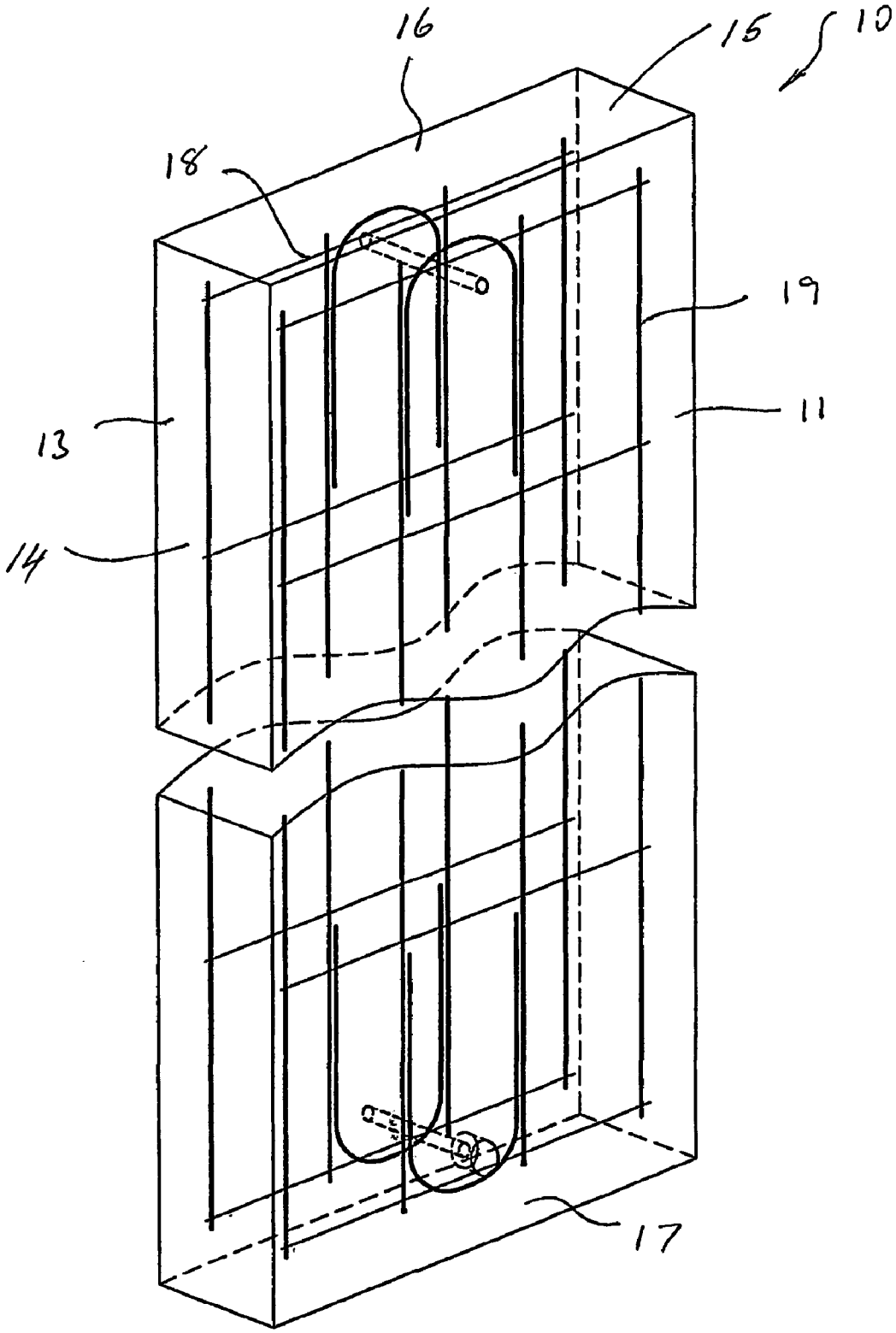
FIG. 1 is a schematic isometric view of a load bearing building panel constructed in accordance with the present invention.
Figure 2:
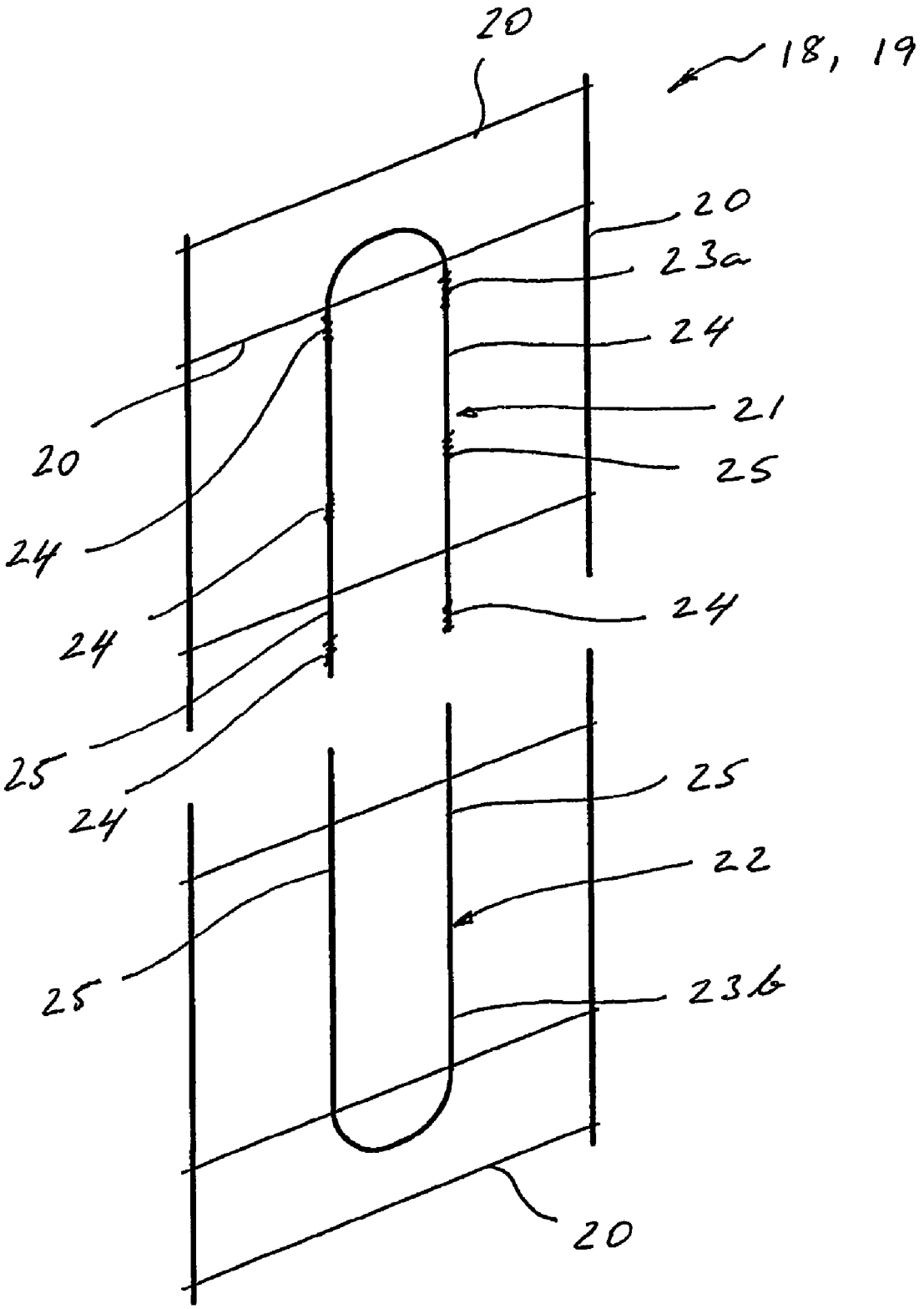
FIG. 2 is a schematic isometric view of a reinforcing used in the construction of the load bearing building panel illustrated in FIG. 1.

FIG. 1 shows a typical load bearing building panel 10 that for convenience is broken in the middle. The load bearing building panel or panel 10 includes a body 11 that generally resembles a rectangular shaped prism.

The body includes an obverse face 12 and an opposing reverse face 13, as well as two opposing side faces 14 and 15. The obverse face 12, reverse face 13 and the two side faces 14 and 15 are located intermediate opposing upper and lower faces 16 and 17 respectively.

The body also includes a first reinforcing 18 and a second reinforcing 19. The reinforcing 18 and the reinforcing 19 each comprise two sets of interconnected steel rod like members 20 that are arranged so as to form a mesh like sheet. In particular the two sets of steel rods are arranged such that they are at 90 degrees to each other, one set being substantially parallel to the edges of the panel 10, the other set being substantially parallel to the top and the base of the panel 10. Each reinforcing 18 and 19 also includes an upper engagement portion 21 and a lower engagement portion 22.

Each engagement portion 21 and 22 comprises a generally "U" shaped steel rod 23 that is welded to the mesh like sheet at points 24 along it's length. By way of example, the "U" shaped steel rod is attached to the internal face of the reinforcing 18 or 19.

Preferably the "legs" 25 of the "U" shaped steel rod 23 overlie the longitudinally extending steel rods from which the reinforcing is made. For example, the "U" shaped steel rod 23*a* may be located approximately 50 mm from the upper face 16 (i.e. 50 mm cover), and overlies 300 mm of the reinforcing. Similarly, the "U" shaped steel rod 23*b* may be located approximately 125 mm from the lower face 17(i.e. 125 mm cover).

The body is constructed from a light weight concrete material, such as that which is referred to as "Autoclave Aerated Concrete", and wherein rectangular box shaped waterproof moulds may be used in the construction of same. These are required to hold the lightweight concrete while it sets or cures. Preferably these are capable of individual adjustment in length from 1800 mm to 3600 mm, in width from 300 mm to 900 mm, and in depth from 70 mm to 150 mm.

The first reinforcing 18 is cast in the panel 25mm to 50 mm from the reverse or internal face 14 of the panel. The second reinforcing 19 is cast in the panel 10 approximately 25 mm to 50 mm from the obverse or external face 13 of the panel. A minimum concrete cover (i.e. distance from steel to external faces of concrete) of 30 mm is to be allowed to sides, top and base of panels.

Two metal or plastic sleeves having an internal diameter of 14 mm and length varying from 70 mm to 150 mm, depending on panel thickness, are preferably cast in the panel to provide for a through bolt fixing to the top and the base of the panel. These sleeves are to be located equidistant from the sides of panel, one 75 mm from the centre of sleeve to top of panel, and the other 150 mm from the centre of sleeve to base of panel. In some panels, a 14 mm diameter hole will be cast in the panel in lieu, in the same locations as above and with the same distances from hole centre to top of panel and base of panel.

Having filled the rectangular box shaped mould with a light weight concrete mix, the mix should be allowed to set or cure.

Figure 3:
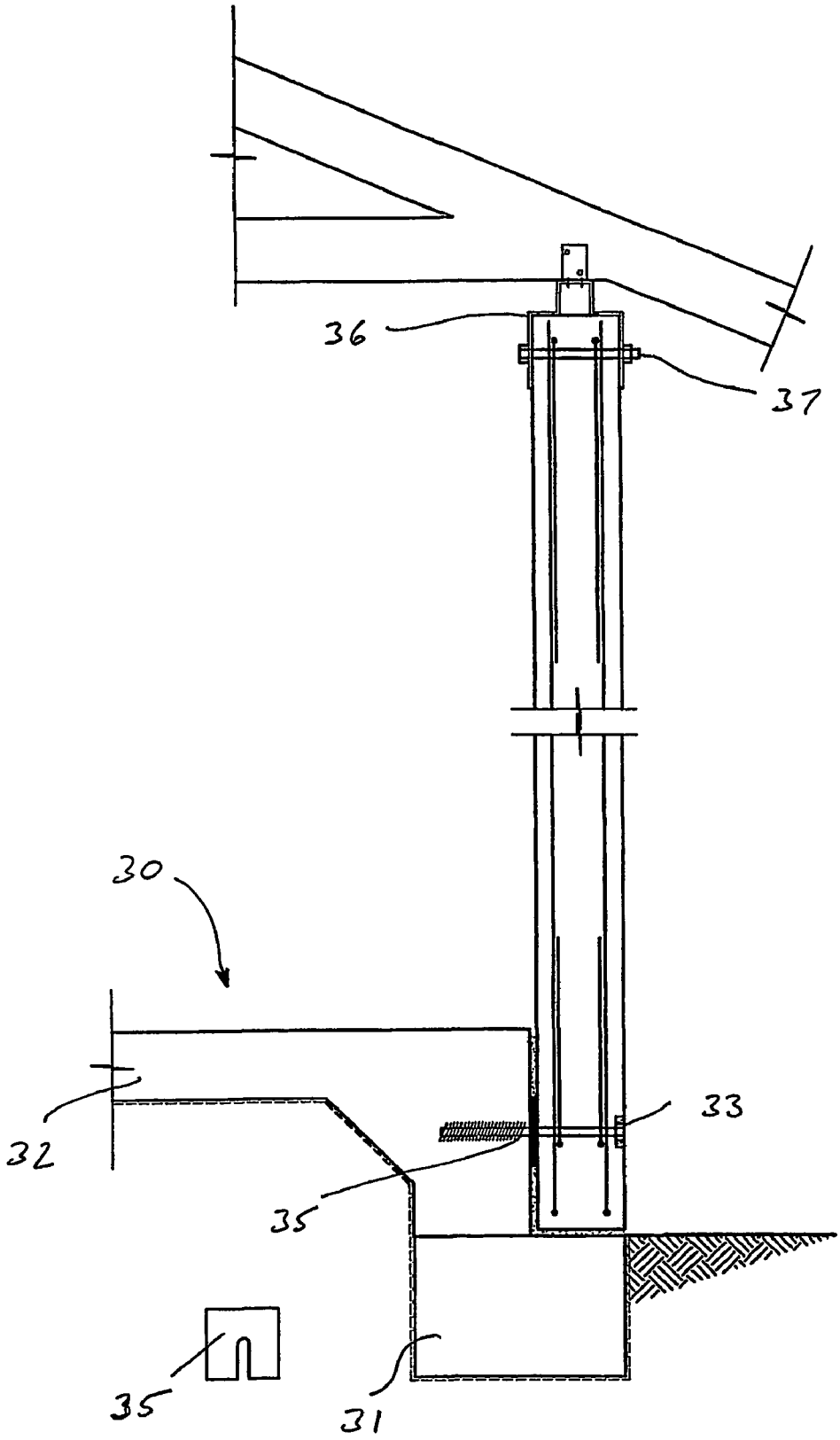
FIG. 3 is a side view of a portion of a single story building constructed in accordance with the present invention.
Figure 4:
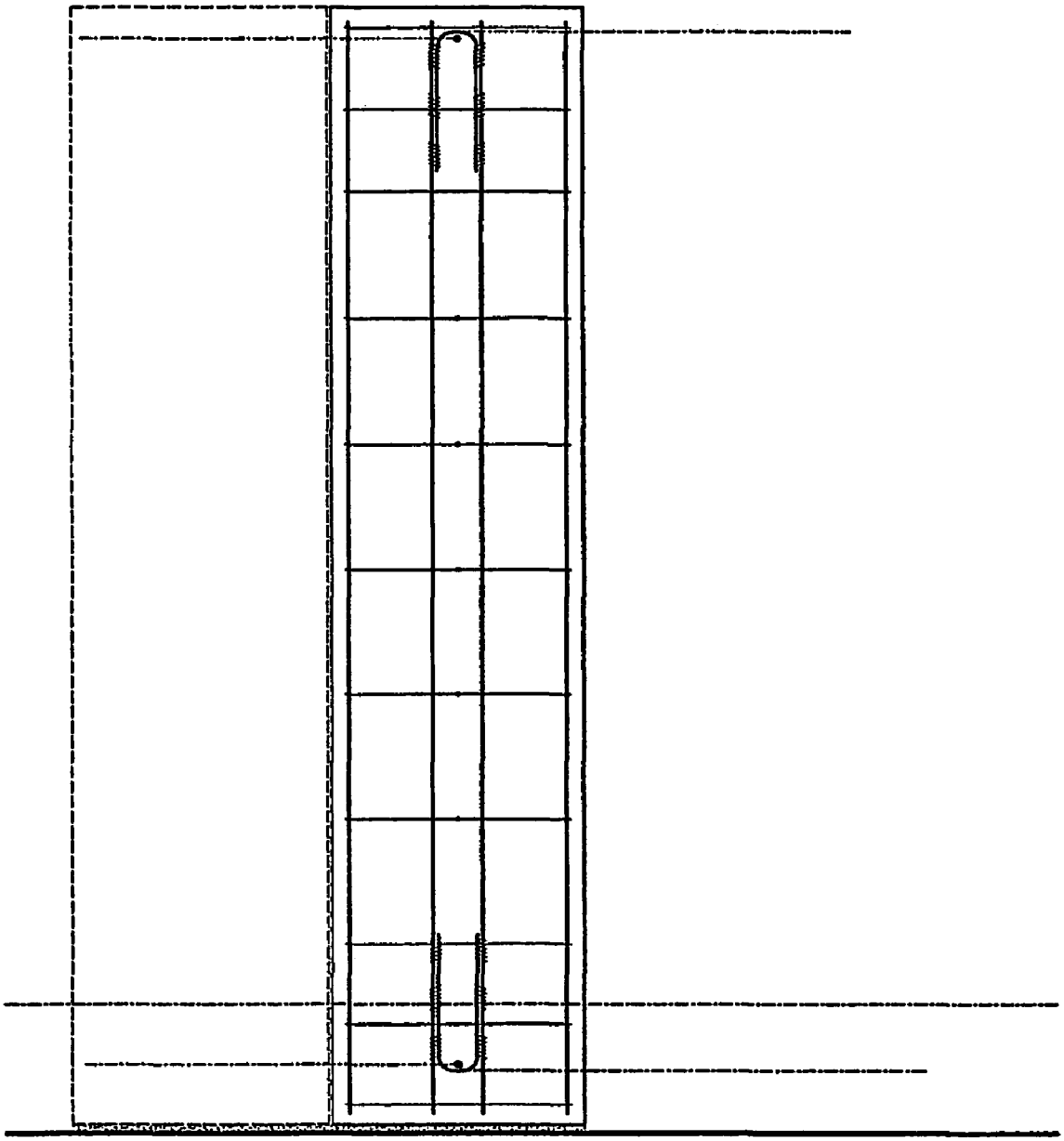
FIG. 4 is a cross-sectional front view showing part of a wall of the of the building illustrated in FIG. 3.
Figure 5:
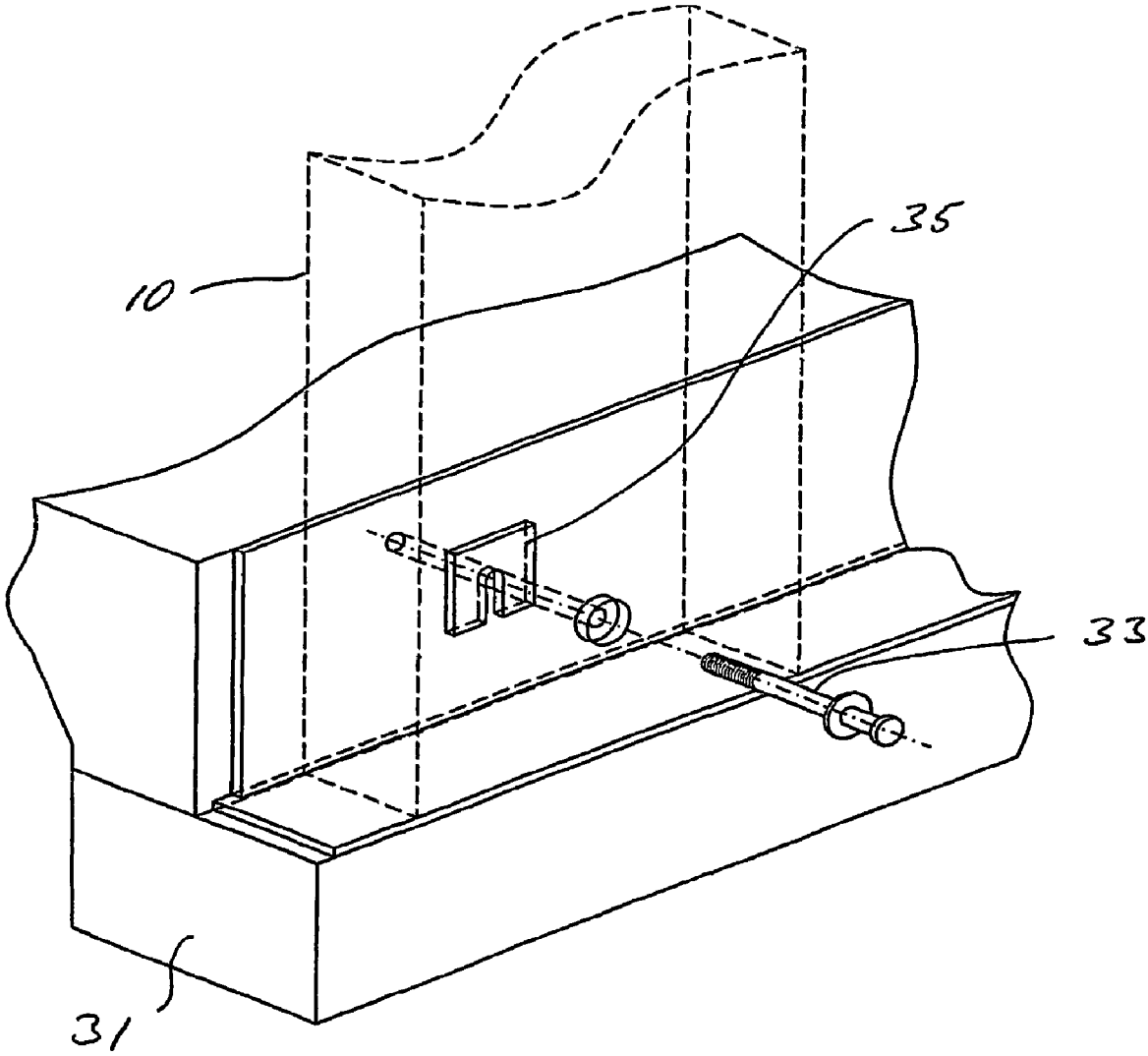
FIG. 5 is a detailed isometric view showing a portion of the foundation of the building illustrated in FIG. 3.

FIGS. 3, 4 and 5 show a portions of a typical building that comprises load bearing building panels 10 of the type described above.

The building includes a foundation 30 consisting of reinforced concrete footings 31 and a slab 32 which are laid in accordance with standard building practice, with a 310 mm high×sheet thickness plus 10 mm wide step down formed around the full perimeter of the building. A 10 mm thick leveling bed of mortar is laid over a damp proof course to the horizontal surface of this step down, and for the full perimeter of the building.

The reinforced lightweight concrete wall panel 10 is located and fixed with a proprietary adhesive to the leveling bed and temporarily propped as per conventional building practice. Then the panel 10 is bottom fixed with a single M12 stainless steel Trubolt 33 through the cast in metal or plastic sleeves, or 14 mm diameter hole, and fixed 125 mm into slab face as illustrated in FIG. 3. The 10 mm PCV packer 35 must be located over the Trubolt 33 prior to tightening.

Another reinforced lightweight concrete panel is then similarly located in place beside the first and vertical edge fixed to preceding panel with a proprietary adhesive, and in accordance with manufacturer's specification. Panel is then bottom fixed as per first panel. This procedure is continued around the building's perimeter until all of the external walls are completed.

Window and door openings are constructed preferably using standard reinforced lightweight concrete lintels, having 450 bearing each end and M12 tie down rods each side of openings. Over wider openings, e.g. double garage door openings, domestic steel-framed lintels are to be used with FC cladding externally to accept render finish.

When the panel bedding joint and vertical joint adhesive has set, interior domestic steel-framed bracing walls are to be installed at intervals not exceeding 9.0 to facilitate removal of temporary props. Liquid grout is then poured into the 10 mm gap between case of wall panels and concrete slab to bond the two components together, which provides added strength.

A steel top plate 36 is now fixed in place by fasteners 37 to provide continuity of tie down to roof framing. The roof structure 38 in turn is secured to the top plates as illustrated.

Expansion or control joints are preferably placed at approx' 6.0 centers for the full perimeter of the reinforced lightweight concrete wall panels.

It will be appreciated that the light weight panels 10 may be located in place by two men or a bobcat and accordingly overcome some of the problems associated with tilt-up construction. Further, it will be appreciated that the method of construction described above is less labor intensive than more conventional methods of construction.

It will also be appreciated that the use of light weight concrete in the construction of the load bearing panels lessens the loading on the footings or lower structure of the building.

FIGS. 6 to 10 illustrate an alternative method of constructing buildings that includes a load bearing steel frame to which cladding, comprising lightweight concrete panels has been attached thereto.

Figure 6:
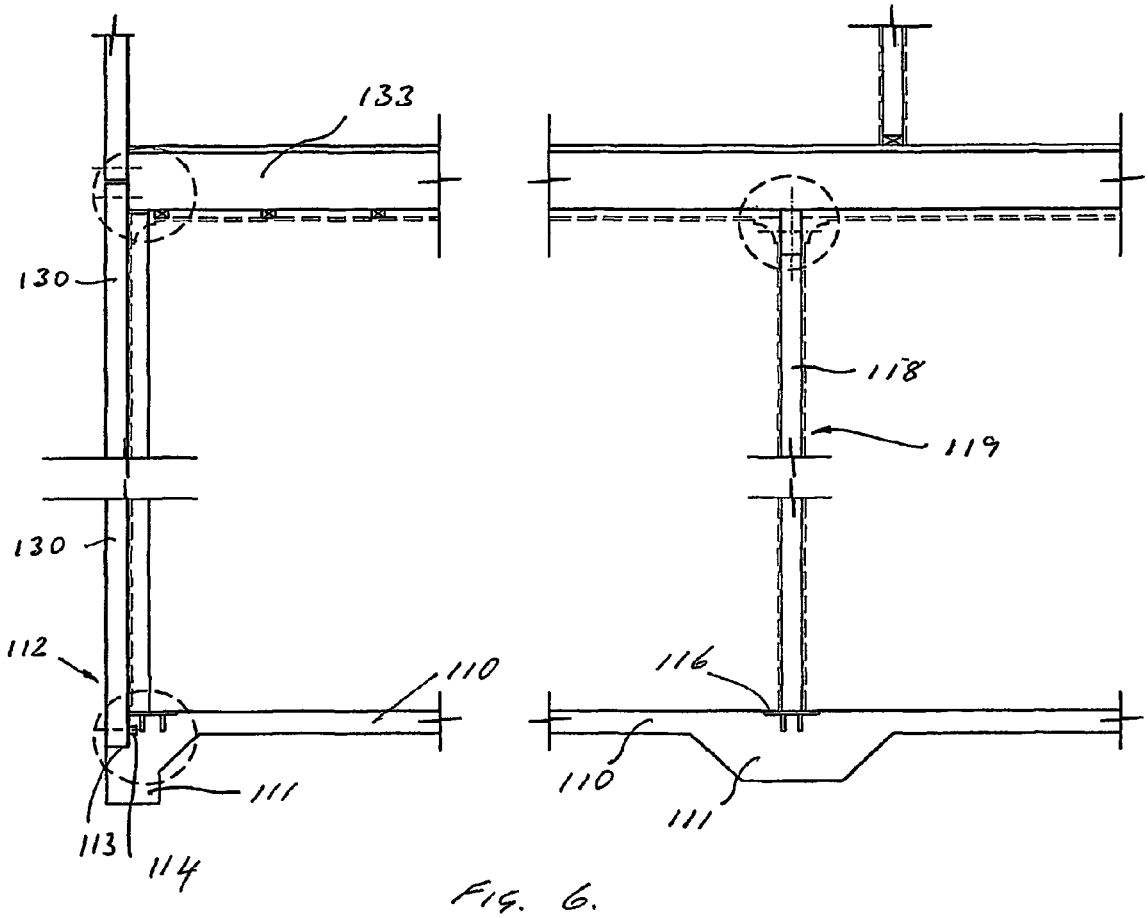
FIG. 6 is a side view of a portion of a double story building constructed in accordance with a different aspect o f the present invention.

With particular reference to FIG. 6, the building includes a foundation 110, comprising a concrete slab 111 having peripheral edge portions 112 in which there is formed a stepped recesses 113.

During the pouring of the concrete slab 111, a hollow extruded section 114, having a tapered cross-sectional shape, may be set into a vertical wall 115 of the recess 113. Preferably the extruded section is manufactured from alluminium or zincallum.

Figure 10:
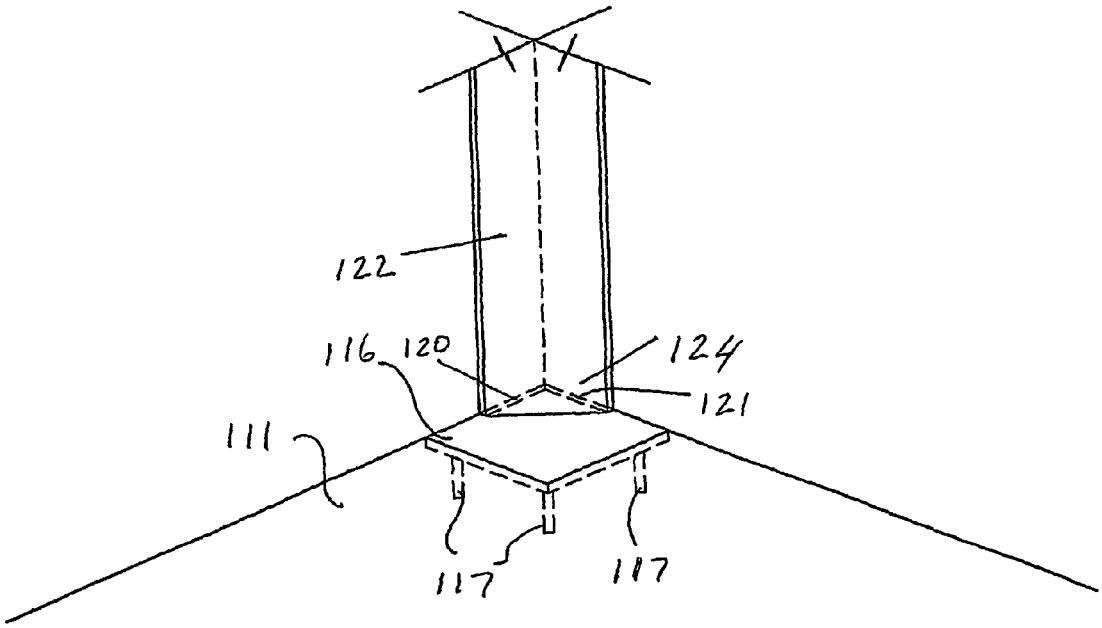
FIG. 10 is a perspective view of a lower part of the building shown in FIG. 8.

Base plates 116 manufactured from mild steel, and having a plurality of dependent projections 117 are preferably set into the concrete slab 111, at the time when the slab is poured. Preferably the base plates 116 are located on the slab 111 where it is desirous to place a load bearing steel column 118, such as the corners of the slab 111, as illustrated in FIG. 10, or where an internal wall 119 shall be located.

The columns 118 are each manufactured from lengths of hollow extruded mild steel 123 and wherein the cross-sectional shape of the sections generally resembles an equilateral triangle having elongate rectangularly shaped side faces 120, 121 and 122.

The lower portion 124 of each extrusion 123 is preferably welded to a corner portion of a respective, rectangularly shaped, base plate 116.

The upper portion of each extrusion 123 is preferably welded to a corner portion of a respective, rectangularly shaped, top plate 125, that is preferably manufactured from mild steel.

Figure 9:
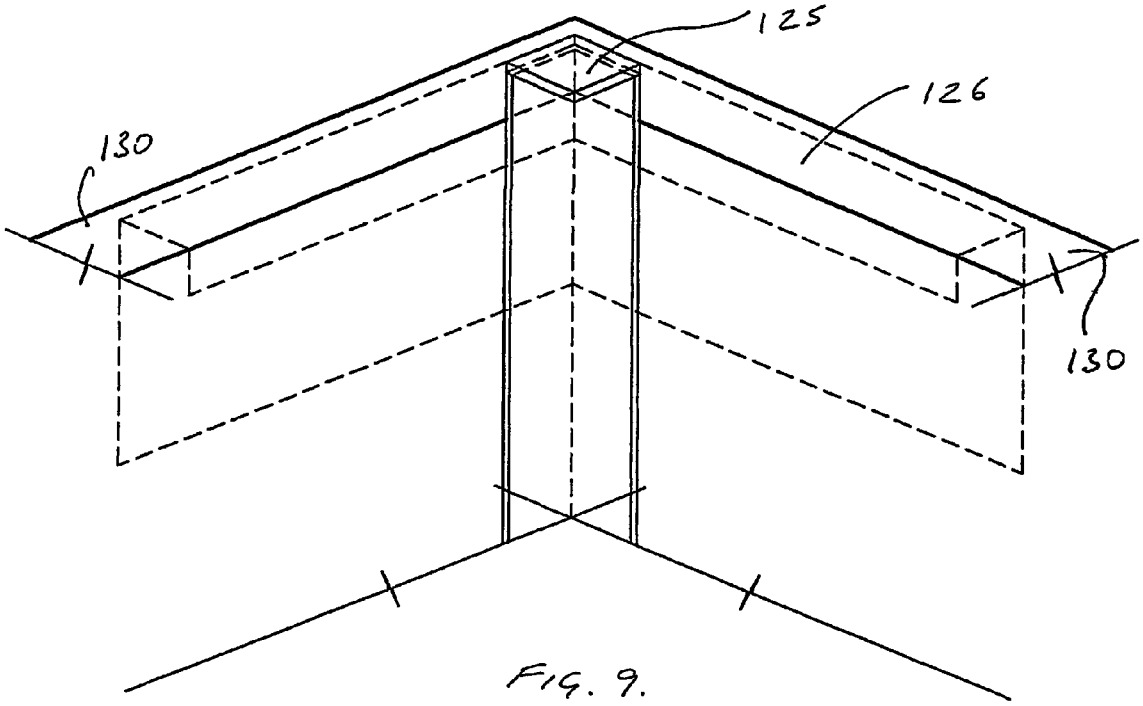
FIG. 9 is a perspective view of an upper part of the building shown in FIG. 8.

Selective free upper ends of the columns 118 may be interconnected by "L" shaped metal lintels 126, as illustrated in FIGS. 8 and 9, and wherein the lintels are used to support a roof structure 127.

The exterior of the building is preferably clad with wall panels 130 constructed from reinforced lightweight concrete. The lower edge portions of the panels preferably locate within a suitable recess 113 formed in the slab 111 and are attached thereto by fasteners 131, not shown, that extend through the panel and engage with the section 114. The upper edge portions of the panels 130, in the case of a single story building, are secured to the upper ends of adjacent columns 118 using fasteners, not shown, that extend through the panel and engage with the column. In the case of a multi story building, the upper edge portions of the panels 130 may be secured to frame members 132 used to support flooring.

Preferably converging wall panels that form a corner of the building each abut an opposing side face of an adjacent column 118, as illustrated in FIG. 9, and if desired, may be attached thereto.

Similarly, wall panels, whether they be constructed from reinforced concrete or from other materials, that are used in the construction of internal walls which converge to form a corner each abut an opposing side face of an adjacent column 118, and if desired, may be attached thereto.

Figure 7:
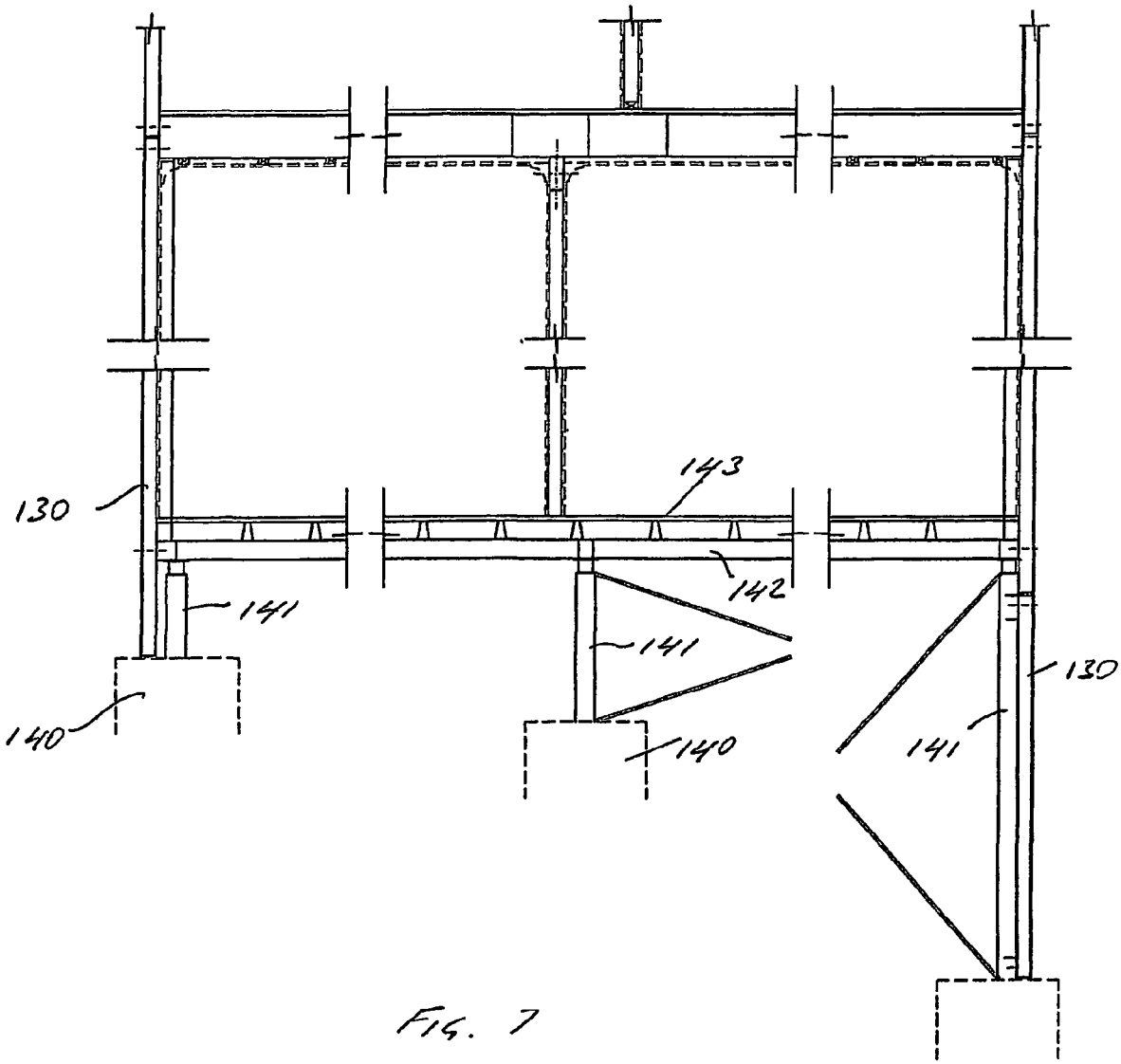
FIG. 7 is a side view of another double story building constructed in accordance with the invention illustrated in FIG. 6.

FIG. 7 shows a building that has been constructed in a manner similar to that illustrated in FIGS. 6, 8, 9 and 10 but wherein the foundation comprises several concrete footings 140 buried in the ground and pillars 141, mounted on said footings 140, upon which a frame 142 that supporting flooring 143 rests.

It will of course be realised that while the foregoing description has been given by way of example of this invention, all other modifications and variations thereto as would be apparent to persons skilled in the art are deemed to fall within the broad scope and ambit of this invention as described and claimed herein.

The invention claimed is:

1. A load bearing building panel, comprising:

a body composed of a light weight concrete material, said body having an obverse face and an opposing reverse face, and two opposing side faces, said obverse face, reverse face and side faces being located intermediate opposing upper and lower faces;

a first reinforcing contained within said body and located adjacent said obverse face, said first reinforcing extending through said body in the general direction of said upper and lower faces for at least much of the length of said body, said first reinforcing also extending through said body in the general direction of the side walls for at least much of the width of said body;

a second reinforcing contained within said body and located adjacent said reverse face, said second reinforcing extending through said body in the general direction of said upper and lower faces for at least much of the length of said body, said second reinforcing also extending through said body in the general direction of said side walls for at least much of the width of said body;

an upper passageway extending through said body from said obverse face to said reverse face for receiving a first fastener;

a lower passageway extending through said body from said obverse face to said reverse face for receiving a second fastener;

an upper engaging portion retained within said body that forms part of or is attached to said first reinforcing or second reinforcing, said upper engaging portion at least partially extending around said upper passageway; and a lower engaging portion retained within said body that forms part of or is attached to said first reinforcing or second reinforcing, said lower engaging portion at least partially extending around said lower passageway.

2. The load bearing building panel of claim 1, wherein said upper passageway is formed by an upper sleeve that engages said upper engaging portion and said lower passageway is formed by a lower sleeve that engages said lower engaging portion.

3. The load bearing building panel of claim 2, wherein said first reinforcing and said second reinforcing are each sheet-like and include a plurality of apertures, and wherein one of said apertures constitutes said upper engaging portion and another of said apertures constitutes said lower engaging portion.

4. The load bearing building panel of claim 2, wherein said first reinforcing and said second reinforcing each comprise a mesh-like structure, said upper engaging portion comprising a first loop-like reinforcing member that is attached to one of said first reinforcing and said second reinforcing, and said lower engaging portion comprising a second loop-like reinforcing member that is attached to one of said first reinforcing and said second reinforcing.

5. A method of constructing a building with a plurality of load bearing building panels, each load bearing building panel comprising a body composed of a light weight concrete material, said body having an obverse face and an opposing reverse face, and two opposing side faces, said obverse face, reverse face and side faces being located intermediate opposing upper and lower faces; a first reinforcing contained within said body and located adjacent said obverse face, said first reinforcing extending through said body in the general direction of said upper and lower faces for at least much of the length of said body, said first reinforcing also extending through said body in the general direction of the side walls for at least much of the width of said body; a second reinforcing contained within said body and located adjacent said reverse face, said second reinforcing extending through said body in the general direction of said upper and lower faces for at least much of the length of said body, said second reinforcing also extending through said body in the general direction of said side walls for at least much of the width of said body; an upper passageway extending from said obverse face to said reverse face for receiving a first fastener; a lower passageway extending from said obverse face to said reverse face for receiving a second fastener; an upper engaging portion that forms part of or is attached to said first reinforcing or second reinforcing, said upper engaging portion at least partially extending around said upper passageway; and a lower engaging portion that forms part of or is attached to said first reinforcing or second reinforcing, said lower engaging portion at least partially extending around said lower passageway, the method comprising: providing a foundation;

erecting one of more external walls, wherein at least one external wall comprises at least one of said load bearing building panels, wherein said at least one load bearing building panel is secured to the foundation by a fastener positioned in the lower passageway;

affixing one of a floor and a roof structure to the at least one load bearing building panel using a fastener positioned in the upper passageway, said one of a floor and a roof structure being spaced from the foundation by said at least one load bearing building panel.

6. A method of constructing a building with a plurality of load bearing building panels, each load bearing building panel comprising a body composed of a light weight concrete material, said body having an obverse face and an opposing reverse face, and two opposing side faces, said obverse face, reverse face and side faces being located intermediate opposing upper and lower faces; a first reinforcing contained within said body and located adjacent said obverse face, said first reinforcing extending through said body in the general direction of said upper and lower faces for at least much of the length of said body, said first reinforcing also extending through said body in the general direction of the side walls for at least much of the width of said body; a second reinforcing contained within said body and located adjacent said reverse face, said second reinforcing extending through said body in the general direction of said upper and lower faces for at least much of the length of said body, said second reinforcing also extending through said body in the general direction of said side walls for at least much of the width of said body; an upper passageway extending from said obverse face to said reverse face for receiving a first fastener; a lower passageway extending from said obverse face to said reverse face for receiving a second fastener; an upper engaging portion that forms part of or is attached to said first reinforcing or second reinforcing, said upper engaging portion at least partially extending around said upper passageway; a lower engaging portion that forms part of or is attached to said first reinforcing or second reinforcing, said lower engaging portion at least partially extending around said lower passageway; and wherein said upper passageway is formed by an upper sleeve that engages said upper engaging portion and said lower passageway is formed by a lower sleeve that engages said lower engaging portion, the method comprising:

providing a foundation;

erecting one of more external walls, wherein at least one external wall comprises at least one of said load bearing building panels, wherein said at least one load bearing building panel is secured to the foundation by a fastener positioned in the lower passageway;

affixing one of a floor and a roof structure to the at least one load bearing building panel using a fastener positioned in the upper passageway, said one of a floor and a roof structure being spaced from the foundation by said at least one load bearing building panel.

7. A method of constructing a building with a plurality of load bearing building panels, each load bearing building panel comprising a body composed of a light weight concrete material, said body having an obverse face and an opposing reverse face, and two opposing side faces, said obverse face, reverse face and side faces being located intermediate opposing upper and lower faces; a first reinforcing contained within said body and located adjacent said obverse face, said first reinforcing extending through said body in the general direction of said upper and lower faces for at least much of the length of said body, said first reinforcing also extending through said body in the general direction of the side walls for at least much of the width of said body; a second reinforcing contained within said body and located adjacent said reverse face, said second reinforcing extending through said body in the general direction of said upper and lower faces for at least much of the length of said body, said second reinforcing also extending through said body in the general direction of said side walls for at least much of the width of said body; an upper passageway extending from said obverse face to said reverse face for receiving a first fastener; a lower passageway extending from said obverse face to said reverse face for receiving a second fastener; an upper engaging portion that forms part of or is attached to said first reinforcing or second reinforcing, said upper engaging portion at least partially extending around said upper passageway; a lower engaging portion that forms part of or is attached to said first reinforcing or second reinforcing, said lower engaging portion at least partially extending around said lower passageway; wherein said upper passageway is formed by an upper sleeve that engages said upper engaging portion and said lower passageway is formed by a lower sleeve that engages said lower engaging portion; and wherein said first reinforcing and said second reinforcing are each sheet-like and include a plurality of apertures, and wherein one of said apertures constitutes said upper engaging portion and another of said apertures constitutes said lower engaging portion, the method comprising:

providing a foundation;

erecting one of more external walls, wherein at least one external wall comprises at least one of said load bearing building panels, wherein said at least one load bearing building panel is secured to the foundation by a fastener positioned in the lower passageway;

affixing one of a floor and a roof structure to the at least one load bearing building panel using a fastener positioned in the upper passageway, said one of a floor and a roof structure being spaced from the foundation by said at least one load bearing building panel.

8. A method of constructing a building with a plurality of load bearing building panels, each load bearing building panel comprising a body composed of a light weight concrete material, said body having an obverse face and an opposing reverse face, and two opposing side faces, said obverse face, reverse face and side faces being located intermediate opposing upper and lower faces; a first reinforcing contained within said body and located adjacent said obverse face, said first reinforcing extending through said body in the general direction of said upper and lower faces for at least much of the length of said body, said first reinforcing also extending through said body in the general direction of the side walls for at least much of the width of said body; a second reinforcing contained within said body and located adjacent said reverse face, said second reinforcing extending through said body in the general direction of said upper and lower faces for at least much of the length of said body, said second reinforcing also extending through said body in the general direction of said side walls for at least much of the width of said body; an upper passageway extending from said obverse face to said reverse face for receiving a first fastener; a lower passageway extending from said obverse face to said reverse face for receiving a second fastener; an upper engaging portion that forms part of or is attached to said first reinforcing or second reinforcing, said upper engaging portion at least partially extending around said upper passageway; a lower engaging portion that forms part of or is attached to said first reinforcing or second reinforcing, said lower engaging portion at least partially extending around said lower passageway; wherein said upper passageway is formed by an upper sleeve that engages said upper engaging portion and said lower passageway is formed by a lower sleeve that engages said lower engaging portion; and wherein said first reinforcing and said second reinforcing are each sheet-like and include a plurality of apertures, and wherein said first reinforcing and said second reinforcing each comprise a mesh-like structure, said upper engaging portion comprising a first loop-like reinforcing member that is attached to one of said first reinforcing and said second reinforcing, and said lower engaging portion comprising a second loop-like reinforcing member that is attached to one of said first reinforcing and said second reinforcing, the method comprising:

providing a foundation;

erecting one of more external walls, wherein at least one external wall comprises at least one of said load bearing building panels, wherein said at least one load bearing building panel is secured to the foundation by a fastener positioned in the lower passageway;

affixing one of a floor and a roof structure to the at least one load bearing building panel using a fastener positioned in the upper passageway, said one of a floor and a roof structure being spaced from the foundation by said at least one load bearing building panel.

* * * * *